US006638140B2

(12) United States Patent
Kimura et al.

(10) Patent No.: US 6,638,140 B2
(45) Date of Patent: Oct. 28, 2003

(54) METHOD AND APPARATUS FOR POLISHING

(75) Inventors: Keiichi Kimura, Kanagawa (JP); Takashi Miyoshi, Osaka (JP)

(73) Assignee: Sony Corporation, Tokyo (JP)

( * ) Notice: Subject to any disclaimer, the term of this patent is extended or adjusted under 35 U.S.C. 154(b) by 14 days.

(21) Appl. No.: 09/956,802

(22) Filed: Sep. 21, 2001

(65) Prior Publication Data

US 2002/0058461 A1 May 16, 2002

(30) Foreign Application Priority Data

Sep. 22, 2000 (JP) ..... 2000-289444

(51) Int. Cl.[7] ..... B24B 1/00

(52) U.S. Cl. ..... 451/6; 451/5; 451/285; 156/626

(58) Field of Search ..... 451/5, 6, 8, 41, 451/285–290; 156/626, 636–639; 438/692, 691, 693

(56) References Cited

U.S. PATENT DOCUMENTS 5,433,651 A * 7/1995 Lustig et al. ..... 451/6
5,461,007 A * 10/1995 Kobayashi ..... 438/16
6,071,177 A * 6/2000 Lin et al. ..... 451/6
6,120,347 A * 9/2000 Sandhu et al. ..... 451/5
6,425,801 B1 * 7/2002 Takeishi et al. ..... 451/5
6,489,624 B1 * 12/2002 Ushio et al. ..... 250/559.27
6,491,569 B2 * 12/2002 Bibby et al. ..... 451/6
6,503,839 B2 * 1/2003 Gonzales et al. ..... 438/692

FOREIGN PATENT DOCUMENTS

JP 6-328352 11/1994
JP 11-288906 10/1999

* cited by examiner

*Primary Examiner*—Joseph J. Hail, III
*Assistant Examiner*—Anthony Ojini
(74) *Attorney, Agent, or Firm*—Rader, Fishman & Grauer PLLC; Ronald P. Kananen, Esq.

(57) ABSTRACT

In a Chemical Mechanical Polishing flattening processing against a surface with minute bumps and dips in a semiconductor process, this invention provides a method of polishing to be able to perform selective polishing of the bumps. A laser beam is irradiated selectively on the surface of a work piece in accordance with a shape of minute bumps and dips on the surface of the work piece, thereby performing a removal control for the minute region and enabling to selectively polish particularly surface bumps.

7 Claims, 8 Drawing Sheets

METHOD AND APPARATUS FOR POLISHING

CROSS REFERENCES TO RELATED APPLICATIONS

The present document is based on Japanese Priority Document JP 2000-289444, filed in the Japanese Patent Office on Sep. 22, 2000, the entire contents of which being incorporated herein by reference.

BACKGROUND OF THE INVENTION

1. Technical Field of the Invention

This invention relates to a polishing method and a polishing apparatus. More specifically, the present invention relates to the method and the apparatus for polishing a surface of a member to be processed having bumps and dips against a plane or a curved surface intended for processing by using slurry including a particle.

2. Description of the Related Art

As disclosed in Japanese Unexamined Patent Application Publication No. H11-288906, a processing method of a CMP (Chemical Mechanical Polishing) has widely been used conventionally in a flattening process of a semiconductor wafer substrate.

According to the conventional CMP processing method as shown in FIG. 1, an elastic polishing pad 12 is fixedly glued on a rotatable polishing plate 11. On the other hand, a silicon wafer 13 is fixed to an end face of a polishing head 14, and a surface to be polished of the silicon wafer 13 is made crimped to the polishing pad 12 with the bottom up. Under such condition, while slurry 15 is supplied, the polishing plate 11 and the polishing head 14 are respectively rotated, thereby the surface of the silicon wafer 13 is polished.

At this time, the slurry 15 does not flow sufficiently into a portion to be polished because the polishing pad 12 and the silicon wafer 13 are contacted each other under pressurized condition, so that a polishing condition is apt to be unstable. To prevent such unstable polishing condition, the surface of the polishing pad 12 is made dressed by a diamond tool or the like to form a comparatively large bumps and dips for providing slurry puddles. Therefore, on the surface of the polishing pad 12 made of an elastic body, there is formed a fuzzy produced due to scratches caused by the slurry puddles and the dressing tool.

The silicon wafer 13 polished by the CMP processing method as shown in FIG. 1 includes regularly arranged bumps of a wiring pattern 21 or the like on the surface layer of the silicon wafer 13 as shown in FIG. 2, and a thin film layer 22 also covers upper portion of the silicon wafer 13 as an insulation film. Accordingly plural bumps 23 are created on the surface of the thin film layer 22 with an influence of the bumps of the wiring pattern 21. According to the flattening process by the CMP processing method, the flattening process may be achieved by selectively polishing only the bumps 23 of the bumpy surface of the thin film layer 22.

Accordingly, trials have been made to polish by contacting only the bumps 23 of the silicon wafer 13 with the polishing pad 12 by increasing a coefficient of elasticity thereof. However, actually as shown in FIG. 3, the surface of the polishing pad 12 is composed of the elastic body deformed under the pressure and has the shape of fuzz having been created, so that the surface of the polishing pad 12 contacts not only with the bumps 23 but also the dips of the thin film layer 22. Namely, it is not possible to selectively polish only the bumps 23 of the thin film layer 22.

Accordingly, it has been difficult to realize an ideal flattening process to selectively remove the bumps 23 by polishing only the portions of the bumps 23 on a large scale as shown by a removed portion 24 in FIG. 4. Namely, actually as shown in FIG. 5, the removed portion 24 has roughly a constant thickness having no relation with the bumpy surface, and the bumps 23 of the thin film layer 22 formed on the surface of the silicon wafer 13 has been polished in almost uniform even with the progress of polishing, which has presented a problem that flattening is not easy to progress.

Such a phenomenon has been seen also in the case of processing an aspherical lens. Namely, a polishing process is practiced in such method that an aspherical shape obtained normally through a highly accurate grinding process is created, thereafter a damaged surface layer is removed and at the same time a surface roughness as an optical element is secured.

However, according to such polishing process, even if a polishing position and an amount of removal in that position has been calculated in accordance with the prior measurement, the peripheral portion has also been polished at the same time because the shape of removal by polishing has a certain area. In consequence, the region other than intended portion has also been polished, resulting in that accuracy of polishing achieved in the grinding process has been deteriorated on the contrary.

SUMMARY OF THE INVENTION

This invention has been made to solve such above-described problems, and to provide a polishing method and a polishing apparatus for obtaining a plane or a curved surface targeted for polishing by relatively increasing an amount of removal particularly of bumps, when polishing the surface of a member to be processed having bumpy surface.

In the polishing method for polishing the surface of the member to be processed having the bumps and dips against the plane or the curved surface targeted for processing by using a slurry including particles, a principal invention regarding the polishing method relates to the polishing method characterized in that a laser beam is irradiated to a position from which a selectively large amount of removal by polishing is desired to be acquired, thereby relatively increasing the amount of removal by polishing of that position.

Herein, by deciding a traveling route of a laser beam and a scanning position in accordance with a shape of the bumps and dips on the surface of the member, an amount of removal by polishing of the portion irradiated by the laser beam on the surface of the member may relatively be increased. It may also be accepted that a shading mask according to the shape of the bumps and dips on the surface of a member to be processed is disposed in the laser beam path to relatively increase the amount of removal by polishing of the portion irradiated by laser beam on the surface of a member to be processed which is an area exposed through the shading mask.

It may also be accepted that the particles in the slurry are made to be caught and collected on the portion irradiated by the laser beam on the surface of the member through a laser trapping phenomenon occurred by radiation pressure of a laser beam, and concentration rate of the particles in the slurry near the portion irradiated by the laser beam is made locally increased, thereby increasing the amount of removal by polishing on the surface. It may also be accepted that on the portion irradiated by the laser beam on the surface, a chemical reaction layer is made formed by a chemical reaction between the surface of the member and a slurry liquid caused by energy of the laser beam, and the chemical reaction layer is made removed by polishing by the particles in the slurry, thereby increasing the amount of removal by polishing on the surface of the member. It may also be accepted that the particles in the slurry are made to be caught and collected on the portion irradiated by the laser beam on the surface of a member to be processed through the laser trapping phenomenon occurred by the radiation pressure of the laser beam, and the concentration rate of the particles in the slurry near the portion irradiated by the laser beam is made locally increased, and moreover, on the portion irradiated by the laser beam on the surface of the member, the chemical reaction layer is made formed by the chemical reaction between the surface of the member and the slurry liquid caused by energy of the laser beam, and the chemical reaction layer is made removed by polishing with the particles in the slurry, thereby increasing the amount of removal by polishing on the surface of the member to be processed.

It may also be accepted that prior to or during polishing process, a surface shape of the portion to be polished on the surface of the member is measured and stored, and from that measurement data, a position of the laser beam irradiation, a condition of the laser beam irradiation and a condition of polishing are calculated, thereby performing the laser beam irradiation and the polishing process in accordance with a result of that calculation.

In the polishing apparatus for polishing the surface of the member having the bumps and dips against the plane or the curved surface targeted for processing by using the slurry including the particles, a principal invention regarding the polishing apparatus includes; laser optical system for projective irradiation of laser beam; and polishing tool system for providing pressure in an axial direction and rotational motion; and further, this invention relates to the polishing apparatus characterized in that the aforesaid laser optical system and the aforesaid polishing tool system execute relative motion with the surface of the member to be processed, whereby irradiation of laser beam and polishing are performed simultaneously or successively on the same position of the surface of the member to be processed.

Herein, it may be accepted that prior to or during a polishing processing, the surface shape of the portion to be polished on the surface of the member is measured by a shape measuring means, and the measured shape is stored in a storage means, and from the stored measurement data, the position of the laser beam irradiation, the condition of irradiation and the condition of polishing are calculated, and according to the result of the calculation, the aforesaid laser optical system performs the laser irradiation, and the aforesaid polishing tool system performs polishing. It may also be accepted that in the beam path of the laser optical system, the shading mask is disposed, and irradiation of the laser beam is performed selectively in accordance with the shape of the bumps and dips on the surface of a member to be processed through the shading mask.

Other features and advantages of this invention will appear more fully from the following description.

DETAILED DESCRIPTION OF THE PREFERRED EMBODIMENTS

Figure 1:
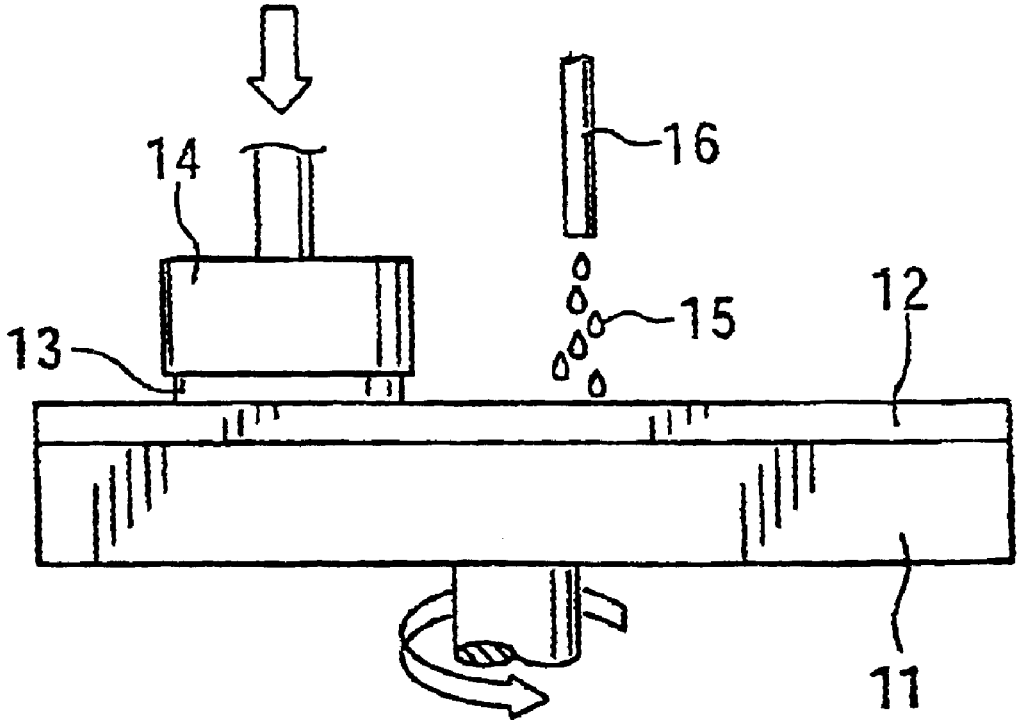
FIG. 1 PRIOR ART
FIG. 1 is a front view showing a CMP processing method.
Figure 2:
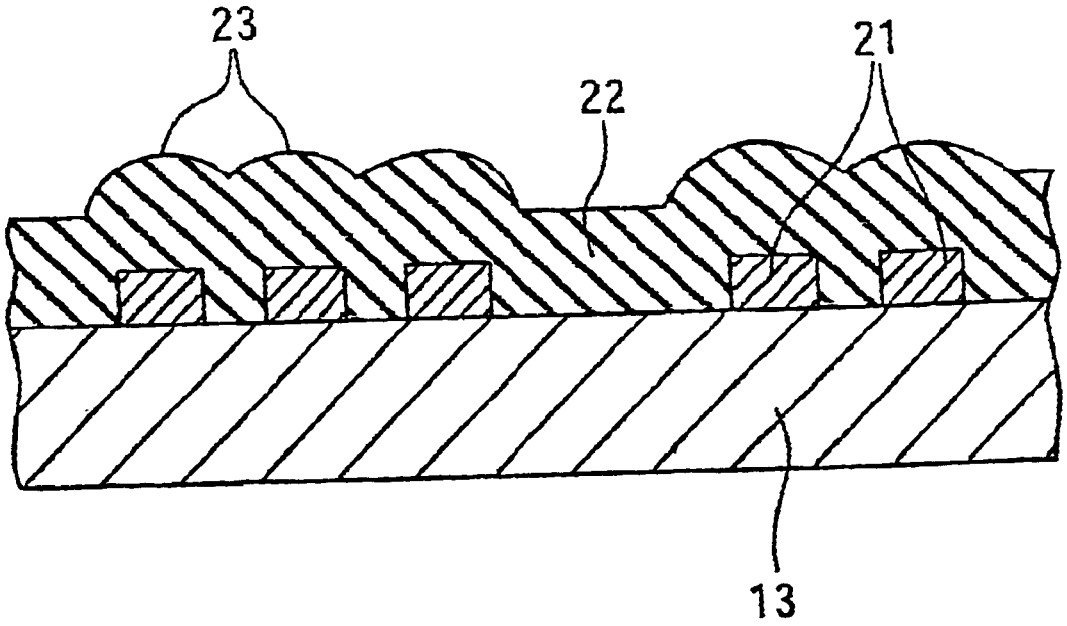
FIG. 2 PRIOR ART
FIG. 2 is an expanded sectional view of the principal part of a silicon wafer on which surface a wiring pattern and an insulating thin film layer are formed.
Figure 4:
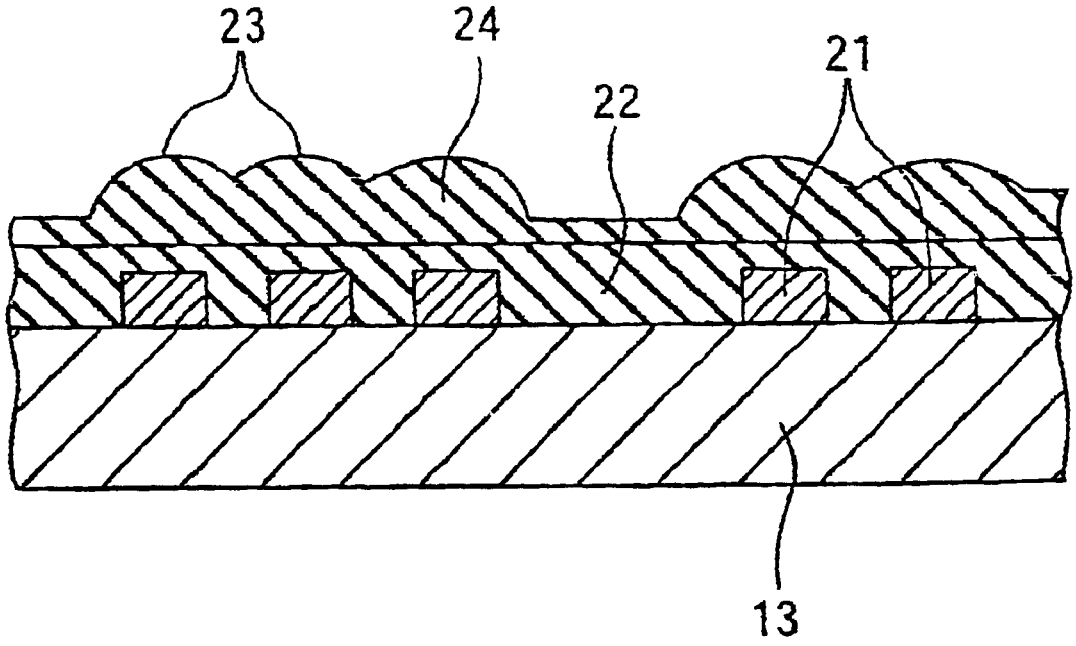
FIG. 4 PRIOR ART
FIG. 4 is an expanded sectional view of the principal part of the silicon wafer showing an ideal polishing of the thin film layer.
Figure 5:
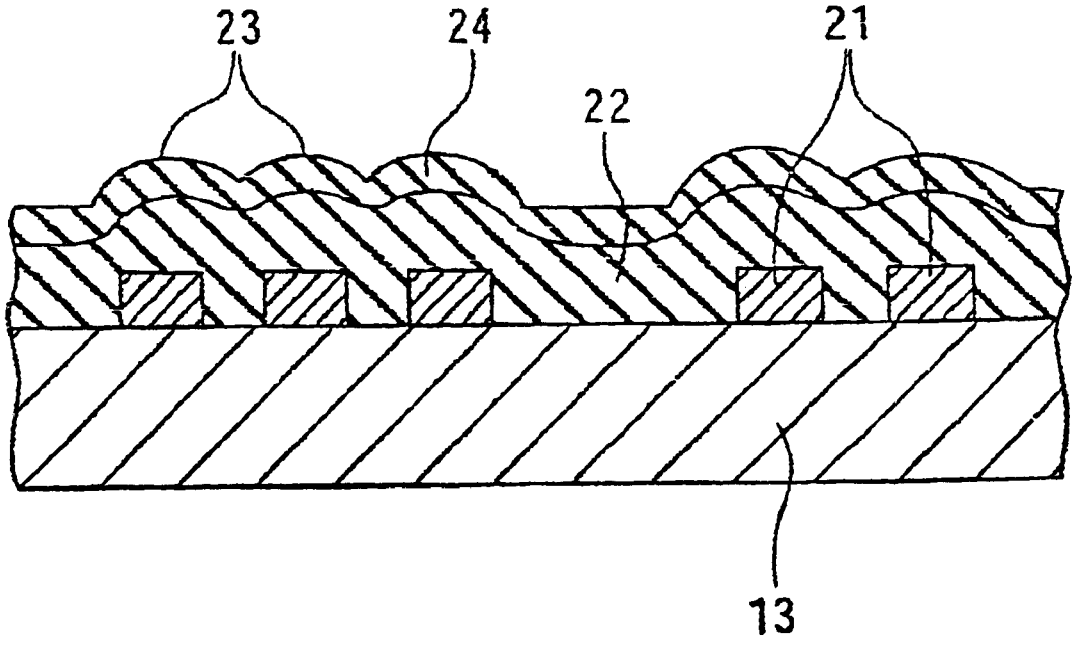
FIG. 5 PRIOR ART
FIG. 5 is an expanded sectional view of the principal part of the silicon wafer showing a conventional polishing of the thin film layer.

In polishing a silicon wafer 13, on which a wiring layer 21 and an insulating layer 22 are formed by using a CMP processing method illustrated in FIG. 1, the present embodiments, as shown in FIG. 2 for example, do not employ a processing method which gets almost uniformed amount of removal 24 from portions with and without bumps 23 shown in FIG. 5, but relatively increase the amount of polishing at the portion where the bumps 23 exist, as shown in FIG. 4, thereby providing a plane surface targeted for processing.

Figure 3:
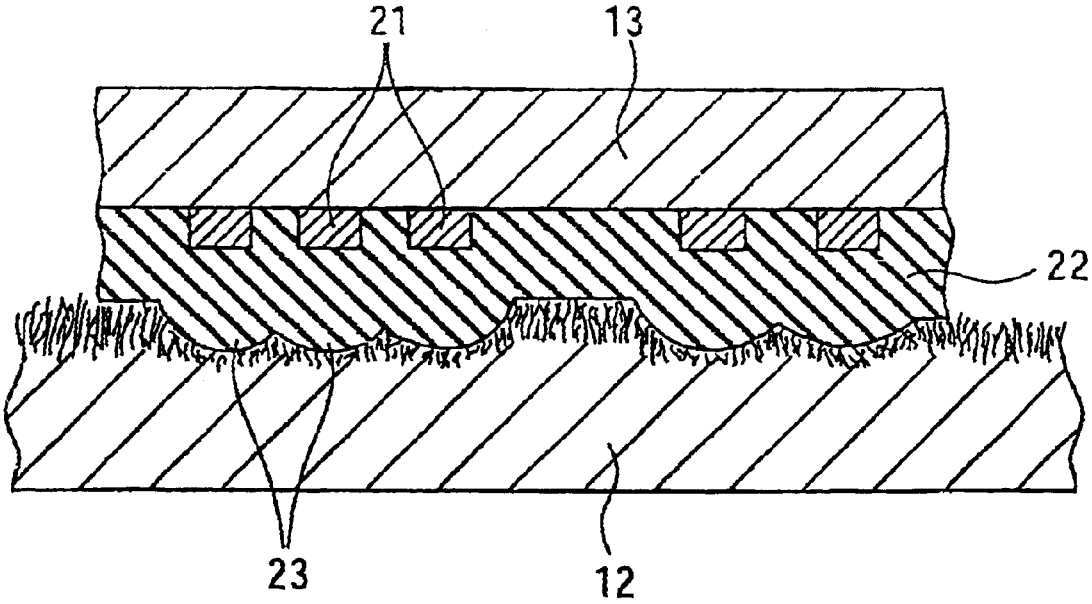
FIG. 3 PRIOR ART
FIG. 3 is an expanded sectional view of the principal part showing a polishing of a thin film layer of the silicon wafer.

The interlayer insulating film 22 of the silicon wafer 13 shown in FIG. 2 has minute bumps with difference in level in the range of, for example, 400 to 500 nm, by influence of bumps of the wiring layer 21 underneath the interlayer insulating film 22, and the interval is several 100 nm to several 100 $\mu$m. For proceeding with flattening of the interlayer insulating film 22 of this case, polishing may be performed in an ideal form as shown in FIG. 4. The ideal form is such that polishing of only bumps 23 out of bumpy surface may be performed relatively and selectively. However, as described above, according to the conventional method, polishing by selectively contacting only with the bumps 23 cannot be performed as illustrated in FIG. 3. Therefore, it is extremely difficult to selectively polish only the bumps 23, so that only the polishing as shown in FIG. 5 has been performed.

For the method of selectively polishing only the bumps 23 within bumpy surface of the interlayer insulating film 22, the present embodiments irradiate a laser beam to an area from which a relatively large amount of removal from the surface of a work piece is desired to be acquired, polish the irradiated area by using a slurry 15 including minute particles for polishing, and perform increasing of the amount of removal by polishing of the area irradiated by the laser beam.

Figure 6:
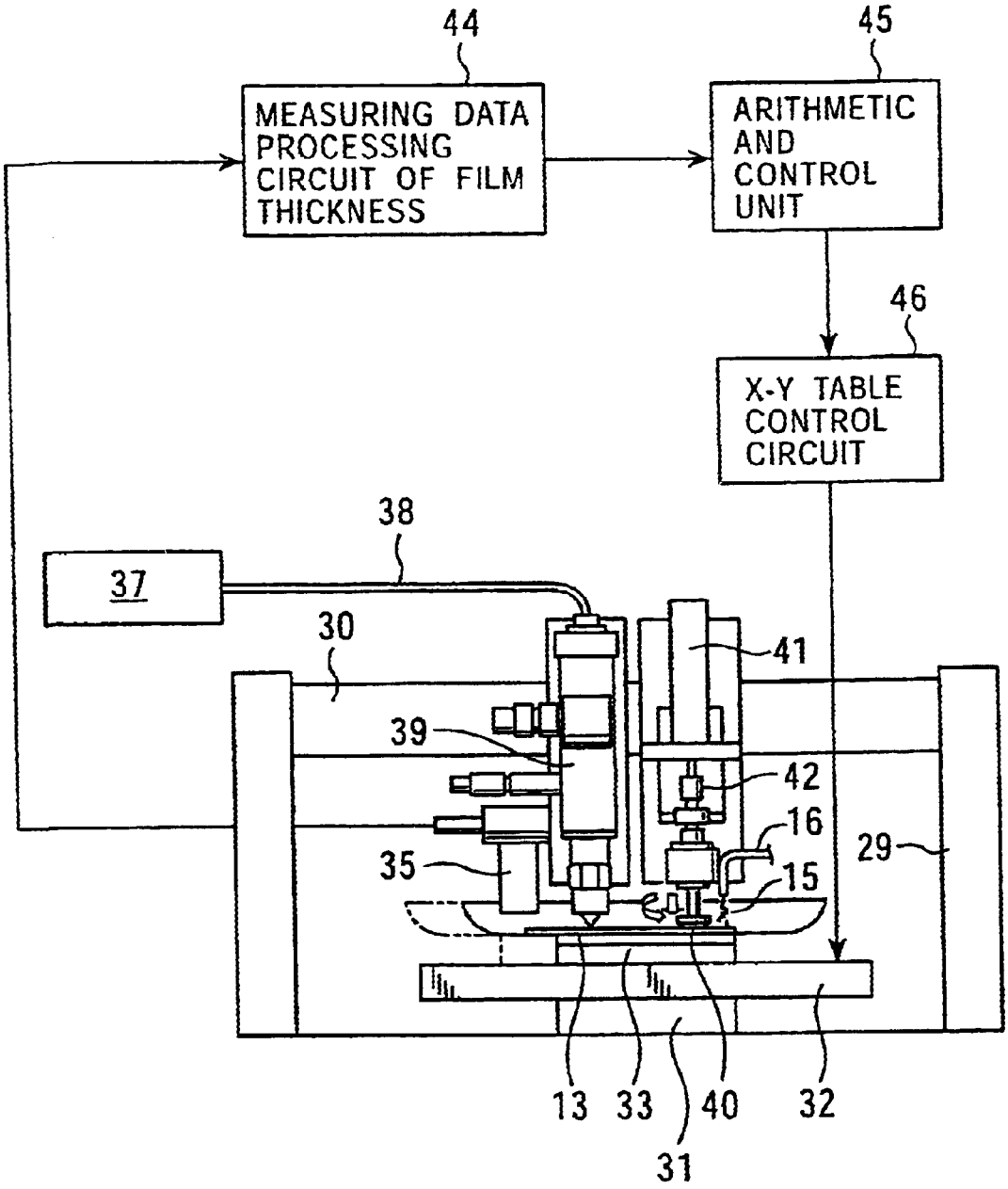
FIG. 6 is a front view of a polishing apparatus.

FIG. 6 shows an outline of an apparatus that realizes such polishing method. This apparatus is equipped with a frame 29 and a stay 30 and composed of a base 31 at the lower part. On the base 31 is disposed a moving table 32 comprising an X-Y table. On the moving table 32 is provided a fixed absorber 33, and the silicon wafer 13 is held absorbed by this fixed absorber 33.

At the oblique upper position of the fixed absorber 33 is disposed a film thickness measuring device 35. This film thickness measuring device 35 is equipped with a YAG (Yttrium Aluminum Garnet) laser 37, which is connected to a laser beam projecting optical system 39 by an optical fiber 38. At the side part of this laser beam projecting optical system 39 is disposed a polishing tool 40, which is installed in connection with a pneumatic cylinder 41. An electric motor 42 is disposed at the output side of the pneumatic cylinder 41. At the side part of the polishing tool 40 is installed a slurry supply device 16, and slurry 15 is supplied through this slurry supply device 16.

The film thickness measuring device 35 as described above is connected to a film thickness measuring data processing circuit 44, and this film thickness measuring data processing circuit 44 is connected to an arithmetic and control unit 45, and furthermore, the above arithmetic and control unit 45 is connected to an X-Y table control circuit 46. A driving control of the moving table 32 comprising the X-Y table is performed by this X-Y table control circuit 46.

Next, there is described an operation of polishing using such device. A work piece of the silicon wafer 13 is fitted by vacuum absorption on the moving table 32 comprising the X-Y table movable in X-Y direction within the horizontal plane via the fixed absorber 33.

Thereafter, according to a command of the X-Y table control circuit 46, the moving table 32 moves leftward in the drawing, namely, below the film thickness measuring device 35, and the film thickness of the surface of the work piece 13 is measured by the film thickness measuring device 35 which is comprised of a multiplex interferometer installed above the work piece 13. Such measured film thickness data, together with coordinate value on the X-Y plane of the moving table 32, are transmitted to the film thickness measuring data processing circuit 44, and after processed in this processing circuit 44, transmitted to the arithmetic and control unit 45 and stored. By performing such measurement of film thickness in overall surface of the work piece 13 at minute interval, the shapes of bumps and dips of the surface of the work piece 13 are to be measured.

Next, the minute particles for polishing and the slurry 15 including chemicals for polishing are supplied on the surface of the work piece 13 by the slurry feeder 16. Thereafter, the moving table 32 is made moved below the laser beam projecting optical system 39 by the command of the control circuit 46. A laser beam flux irradiated from the YAG laser 37 passes through the optical fiber 38 and is irradiated on the surface of the work piece 13 via the projecting optical system 39 installed above the work piece 13.

At this time, according to the shape of the surface of the work piece 13 measured beforehand, the laser beam is irradiated only to the bumps 23 on the surface of the upper portion of the wiring layer 21 of the silicon wafer 13 shown in FIG. 2. This laser beam is irradiated with the single beam flux, and irradiation is performed in such a manner that the surface of the work piece 13 is scanned with moving of the moving table 32. Incidentally, a scanning optical system may be incorporated into the projecting optical system.

Thereafter, according to an output signal of the X-Y table control circuit 46, the moving table 32 moves below the polishing tool 40. With operating simultaneously pressurization and revolving motion by the action of the pneumatic cylinder 41 and the electric motor 42, the polishing tool 40 proceeds with a polishing work by feeding motion of the moving table 32.

Figure 7:
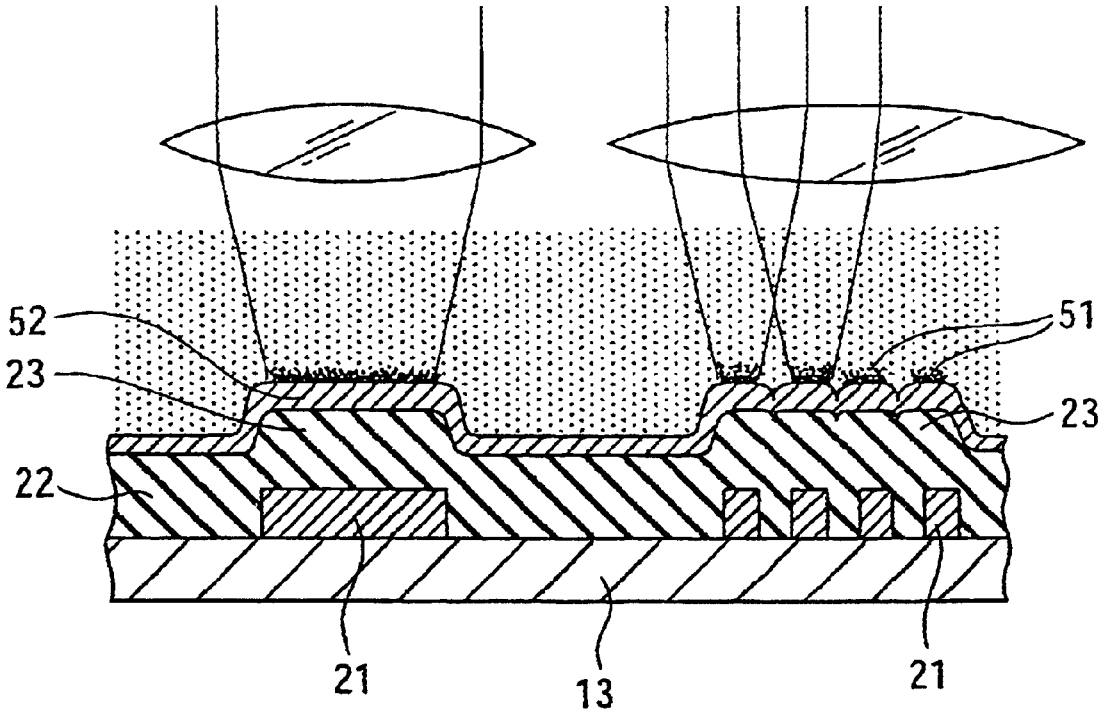
FIG. 7 is an expanded sectional view showing a condition of irradiating the thin film layer on the silicon wafer with laser beam.

At this time, as shown in FIG. 7, by irradiating the surface of the work piece 13 with the laser beam, minute particles 51 in the slurry 15 are condensed and accumulated on the upper part of the bumps 23 by the laser trapping phenomenon on the surface of the work piece 13.

When the laser beam is irradiated to the slurry 15 including the minute particles 51, the minute particles 51 are captured by the laser beam flux with the radiation pressure of the laser beam. This phenomenon is known as the laser trapping phenomenon. In this case, when the surface of the silicon wafer 13 supplied with the slurry 15 is scanned by the laser beam flux, such laser trapping phenomenon is seen as the minute particles 51 are accumulated and caked on the scanning tracks as shown in FIG. 7. This phenomenon is referred to as the laser trapping phenomenon. By performing the polishing after accumulated traces of such minute particles 51 are formed on the bumps 23 of the silicon wafer 13, only the periphery of the accumulated traces of the minute particles 51 is locally polished, and only the surface bumps 23 corresponding to the minute wiring pattern 21 are processed for removal.

At the same time, by a chemical reaction occurred between the thin film layer 22 and chemicals in the slurry 15, a comparatively soft chemical reaction layer 52 is formed on the surface of the work piece 13 as shown in FIG. 7, and particularly at the portion irradiated by the laser beam, the rapid chemical reaction layer 52 is formed by the active chemical reaction.

In other words, when the laser beam flux is irradiated to the silicon wafer 13 supplied with the slurry 15, the chemical reaction layer 52 is actively formed on the surface of the work piece 13 by an increase of temperature of the irradiated portion. This chemical reaction layer 52 is considered as a hydration layer. After the active hydration layer is formed by irradiation of the laser beam, and by polishing process with the slurry 15 to remove this hydration layer, a removal speed of the surface bumps 23 is particularly increased.

Incidentally, for a composition of the slurry 15 used for polishing, the following combination is available for use.

| Abrasive grains (minute particles): | dispersing solution |
|---|---|
| $SiO_2$ | KOH |
| $CeO_2$ | $H_2O$ |
| $SiO_2$ | $NH_4OH$ |
| $Al_2O_3$ | KOH |

As the laser beam projecting optical system 39 can easily narrow the laser beam flux on the range of a width dimension of the bumps and dips, a selective polishing is made possible for the bumps 23 having minute width. By following such process, a highly accurate flattening processing is made possible for the interlayer insulating film 22 or the like on the silicon wafer 13 having the shape of minute bumps and dips, whereby an ideal polishing process to provide extremely high flatness is made available.

This processing method enables to realize a highly accurate flattening with similar operation for not only the interlayer insulating film 22 on the silicon wafer 13 but also a metallic film formed on the silicon wafer 13, for example, a metallic film of copper or the like under the dual damascene process. This method is similarly applicable to the case of polishing the specific position of the work piece with a small polishing tool, such as the case of polishing an aspherical lens, and the highly accurate processing is made realized by improving a resolution of the position within the surface of the member to be processed.

According to the apparatus of the present embodiments especially shown in FIG. 6 and polishing processing method performed by this apparatus, such polishing work is conducted with highly accurate resolution of the position on the occasion that the specific position of the work piece of the silicon wafer 13 or the like is polished with the small tool 15. In performing the CMP flattening processing for the surface with minute bumps and dips under the semiconductor process, a selective polishing for the bumps 23 is possible, whereby an ideal high degree of flatness as shown in FIG. 4 is available.

Such polishing apparatus and the polishing method, as described above, make it possible to flatten the interlayer insulating film 22 on the silicon wafer 13 whose material is mainly $SiO_2$ family. Furthermore, flattening of metallic film of Cu or the like is also made possible. In addition, when this method is applied to the surface polishing of the aspherical lens or the like, highly accurate polishing is made available.

In the above-described embodiments, the laser optical system 39 stops down the laser beam to selectively irradiate the laser beam to the bumps 23 on the thin film layer 22 of the silicon wafer 13. In this case, the laser beam irradiation is performed through scanning by using the X-Y moving table 32. As a substitute for this configuration, the shading mask 58 may be used for irradiating the laser beam without performing scanning.

Figure 8:
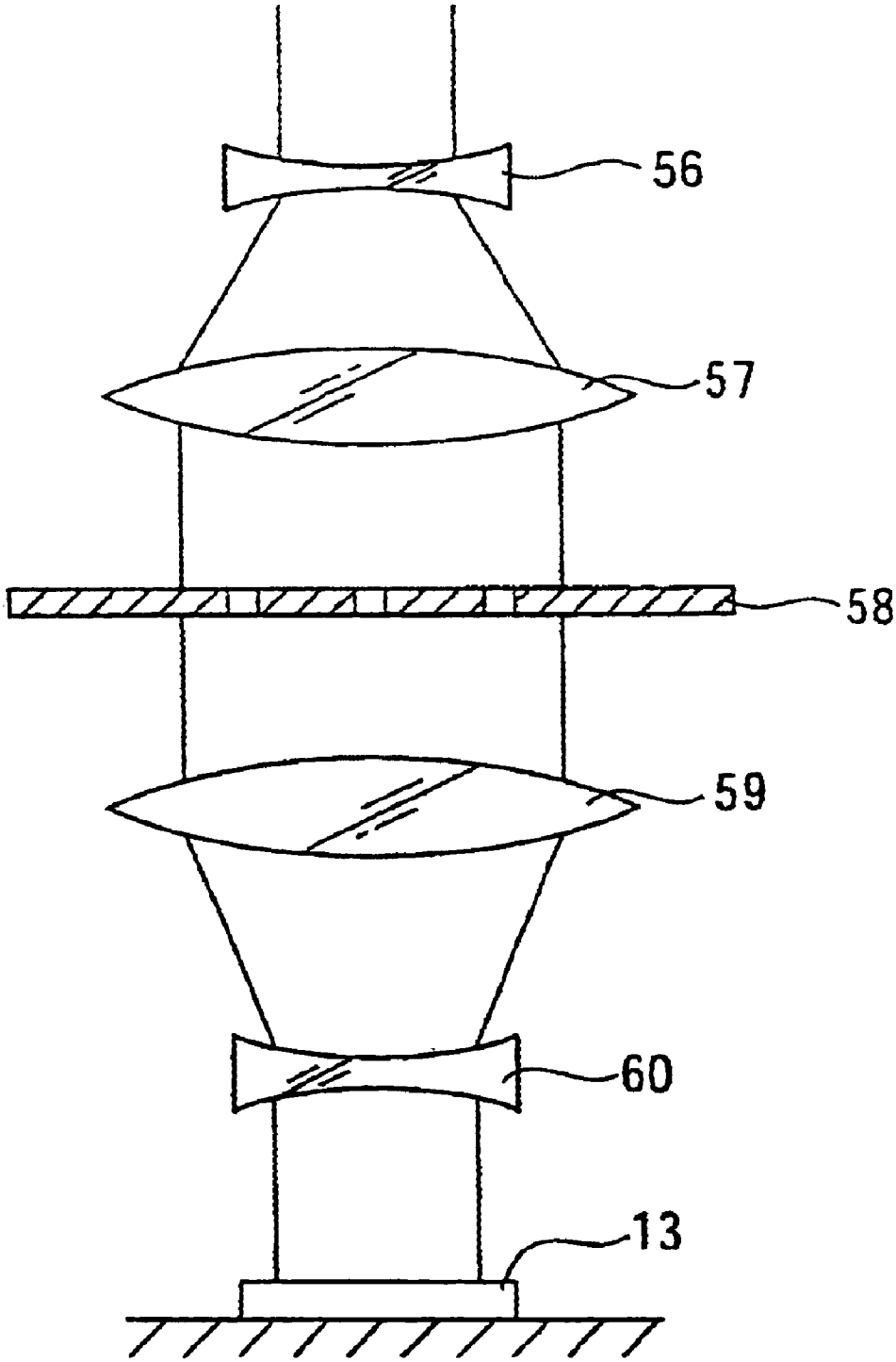
FIG. 8 is a sectional view of the principal part of a laser optical system using a shading mask.

FIG. 8 shows such apparatus, in which an expander lens 56, a converging lens 57, the shading mask 58, the converging lens 59, and a concave lens 60 are disposed in the laser optical system.

The laser beam is diffused by the expander lens 56, the diffused laser beam is converted to parallel beams by the converging lens 57, the paralleled laser beam is allowed to pass through the shading mask 58 and thereafter stopped down by the converging lens 59 and converted to parallel beam by the concave lens 60 to be irradiated on the surface of the silicon wafer 13. According to such laser beam irradiation, the laser beam is irradiated on the surface of the silicon wafer 13 in accordance with patterned shapes of the shading mask 58. Consequently, without performing the laser beam irradiation by scanning using the X-Y moving table 32 and the laser beam projecting optical system 39, the laser beam may selectively be irradiated particularly only on the surface bumps 23 of the thin film layer 22 on the surface of the silicon wafer 13.

In the polishing method for polishing the surface of the member to be processed having bumps and dips against the plane and the curved surface targeted for processing by using a slurry including particles, a principal invention regarding the polishing method allows to relatively increase the amount of removal by polishing by irradiating laser beam to the position from which a selectively large amount of removal by polishing is desired to be acquired.

Accordingly, the portion where the laser beam is irradiated is polished with relatively large amount of polishing especially compared with other portions, which allows to adjust the amount of polishing selectively, and by irradiating the laser beam beforehand to the area of bumps within bumps and dips on the surface, a selective polishing of the bumps is made available.

In the polishing apparatus for polishing the surface of the member having bumps and dips against the plane and the curved surface targeted for processing by using the slurry including the particles, the principal invention regarding the polishing apparatus includes a laser optical system for projective irradiation of the laser beam and a polishing tool system for providing pressure and rotational motion in an axial direction. By relative motion of the laser optical system and the polishing tool system with the surface of the member to be processed, irradiation of laser beam and polishing are performed simultaneously or successively on the same position of the surface of the member.

Consequently, according to such polishing apparatus, it becomes possible to irradiate the laser beam to the designated position of the surface of the member and perform the polishing simultaneously or successively, whereby it becomes possible to provide the polishing apparatus that can selectively polish the designated position on the surface of a member to be processed.

While preferred embodiments of the invention have been described, such description is for illustrative purpose only, and it is to be understood that changes and variations may be made without departing from the spirit and scope of the invention.

What is claimed is:

1. A method of polishing a surface of a member by using a slurry including particles, comprising the steps of:

irradiating a laser beam on a surface position wherefrom a selectively large amount of removal is desired by polishing by scanning said laser beam on said surface of the member in accordance with a traveling route decided according to a shape of bumps and dips formed on the surface of the member; and polishing, with said slurry, said surface position on which said laser beam is irradiated, wherein a concentrating rate of the particles in the slurry near said surface portion irradiated by the laser beam is locally raised by trapping and collecting particles in said slurry on said portion irradiated by the laser beam on the surface through a laser trapping phenomenon due to a radiation pressure of the laser beam.

2. The method according to claim 1, further comprising the steps of:

disposing a shading mask formed corresponding to the shape of said bumps and dips on the surface of the member to be processed in a laser beam path;

irradiating said laser beam through said shading mask on said surface of the member to be processed; and polishing said surface position on which said laser beam is irradiated through said shading mask.

3. The method according to claim 1, further comprising the steps of;

forming a chemical reaction layer provided by a chemical reaction between the surface of the member and the slurry liquid caused by energy of the laser beam on said portion irradiated by the laser beam on the surface of the member; and removing by polishing said chemical reaction layer with the particles in the slurry.

4. A method of polishing a surface of a member by using a slurry including particles, comprising the steps of:

irradiating a laser beam on a surface position wherefrom a selectively large amount of removal is desired by polishing by scanning said laser beam on said surface of the member in accordance with a traveling route decided according to a shape of bumps and dips formed on the surface of the member;

polishing, with said slurry, said surface position on which said laser beam is irradiated;

trapping and collecting the particles in the slurry on said portion irradiated by the laser beam on the surface of the member through said laser trapping phenomenon due to the radiation pressure of the laser beam;

increasing locally a concentration rate of the particles in the slurry near said portion irradiated by the laser beam;

forming said chemical reaction layer provided by a chemical reaction between the surface of the member and the slurry liquid caused by energy of the laser beam on said portion irradiated by the laser beam on the surface of the member; and removing by polishing said chemical reaction layer with the particles in the slurry.

5. The method according to claim 4, further comprising the steps of:

measuring and storing, prior to or during the polishing process, a surface shape of the portion to be polished on the surface of the member;

calculating from said measuring data a position of the laser beam irradiation, a condition of the laser beam irradiation and a condition of a polishing; and performing irradiation of the laser beam and the processing of the polishing according to a result of said calculation.

6. An apparatus for polishing a surface of a member to be processed having bumps and dips, the surface of the member being polished against a plane or curved surface targeted for processing by using a slurry including particles, comprising:

a laser optical system for projective irradiation of a laser beam; and a polishing tool system for providing pressure in an axial direction and rotational motion; whereby said irradiation of the laser beam and said polishing are performed simultaneously or said irradiation and said polishing are performed successively on the same position of the surface of the member by exercising relative motion of said laser optical system and said polishing tool system with the surface of the member;

wherein a concentrating rate of the particles in the slurry near said surface portion irradiated by the laser beam is locally raised by trapping and collecting particles in said slurry on said portion irradiated by the laser beam on the surface through a laser trapping phenomenon due to a radiation pressure of the laser; and wherein a surface shape to be processed is measured by shape measuring means prior to or during the polishing processing;

said measured shape and thickness are stored in a storage means;

a position of laser beam irradiation, a condition of irradiation and a condition of polishing are calculated from stored measurement data; and said laser optical system performs the laser irradiation and said polishing tool system performs the polishing according to the result of said calculation.

7. The apparatus according to claim 6, wherein said shading mask is disposed in the beam path of said laser optical system; and said laser beam irradiation is performed selectively in accordance with the shape of bumps and dips on the surface of a member to be processed through said shading mask.

* * * * *